US006339886B1

(12) United States Patent
Reinhardt

(10) Patent No.: US 6,339,886 B1
(45) Date of Patent: Jan. 22, 2002

(54) REMOTELY MEASURED CALIPER FOR WELLBORE FLUID SAMPLE TAKING INSTRUMENT

(75) Inventor: Paul A. Reinhardt, Houston, TX (US)

(73) Assignee: Baker Hughes, Inc., Houston, TX (US)

( * ) Notice: Subject to any disclaimer, the term of this patent is extended or adjusted under 35 U.S.C. 154(b) by 0 days.

(21) Appl. No.: 09/218,891

(22) Filed: Dec. 22, 1998

(51) Int. Cl.[7] ..... G01B 5/12; G01B 13/10
(52) U.S. Cl. ..... 33/544.2; 33/785; 33/302
(58) Field of Search ..... 33/544.2, 544, 33/302, 306, 307, 783, 785, 544.1, 544.3, 717, 718, 719, 721, DIG. 2; 73/151, 152.17

(56) References Cited

U.S. PATENT DOCUMENTS 3,905,580 A * 9/1975 Hooper ..... 60/413
4,235,021 A * 11/1980 Claycomb ..... 33/307
4,432,143 A * 2/1984 Moriarty ..... 33/544.3
4,507,957 A * 4/1985 Montgomery ..... 73/152.26
4,559,709 A * 12/1985 Beseme et al. ..... 33/544.3
4,793,560 A * 12/1988 Schrodl ..... 241/30
5,299,359 A * 4/1994 Estes ..... 33/544
5,473,939 A * 12/1995 Leder et al. ..... 73/152.12
5,622,223 A * 4/1997 Vasquez ..... 166/264
5,635,631 A * 6/1997 Yesudas et al. ..... 73/63.46
5,644,076 A * 7/1997 Proett et al. ..... 73/152.41
5,680,049 A * 10/1997 Gissler ..... 324/368
6,230,557 B1 * 5/2001 Ciglenec et al. ..... 73/152.01

FOREIGN PATENT DOCUMENTS

GB 1080085 * 8/1967

* cited by examiner

*Primary Examiner*—Diego Gutierrez
*Assistant Examiner*—R. Alexander Smith
(74) *Attorney, Agent, or Firm*—Madan, Mossman & Sriram, PC

(57) ABSTRACT

An apparatus for measuring the internal diameter of a wellbore for a wireline formation sample taking instrument, including an hydraulically actuated probe and back up shoe for selective engagement with the wall of a wellbore, an hydraulic pump and selectively controllable valves for selectively controlling extension and retraction of the probe and back up shoe, and an hydraulic fluid reservoir to supply hydraulic fluid to the pump for extending and retracting the probe and back up shoe. The reservoir includes a pressure compensator for balancing the pressure in the reservoir to an hydrostatic pressure in the wellbore. A position sensor is coupled to the compensator to determine its position. The position of the compensator corresponding to the fluid volume in the reservoir, the extension distance of the probe and back up shoe, and the internal diameter of the wellbore at the location of the probe and back up shoe.

15 Claims, 3 Drawing Sheets

REMOTELY MEASURED CALIPER FOR WELLBORE FLUID SAMPLE TAKING INSTRUMENT

BACKGROUND OF THE INVENTION

1. Field of the Invention

The invention is generally related to the field of wellbore logging instruments. More specifically, the invention is related to devices for measuring the internal diameter of a wellbore to enable more reliable determination of whether a wellbore fluid sample taking instrument is likely to be properly placed in hydraulic communication with earth formations from within the wellbore.

2. Description of the Related Art

Wireline formation fluid sample taking instruments are used to extract samples of connate fluid from earth formations penetrated by a wellbore. Generally, these instruments include a tubular probe which is extended from the housing of the instrument and is hydraulically sealed against the wall of the wellbore. The probe is then selectively placed in hydraulic communication with a pump or a sample chamber, or some similar combination of elements used to withdraw fluid from within the pore spaces of the earth formation. See for example, U.S. Pat. No. 4,507,957 issued to Montgomery et al which describes one type of fluid sample taking instrument.

Wireline formation fluid sample taking instruments are susceptible to failure of a sealing element ("packer") surrounding the probe if the wellbore wall is not smooth, or if the wellbore is substantially enlarged beyond the diameter of a drilling bit used to drill through the earth formations. The packer may also fail to seal properly if the instrument is not properly centered in the wellbore and is put into skewed contact with the wellbore wall. In these cases, when the system operator causes the instrument to withdraw fluid, fluid disposed in the wellbore itself can be drawn across the face of the packer and enter the probe, thereby making the sample unrepresentative of the connate fluid in the earth formation. The system operator can generally determine whether his type of seal failure has occurred by observing measurements of the fluid pressure in the probe. Rapid increase in pressure to the same pressure as the hydrostatic pressure of the fluid in the wellbore typically indicates packer failure. If the cause of the packer failure is roughness of the wellbore wall, slight movement of the instrument along the wellbore may result in a successful reattempt at withdrawing a formation fluid sample.

However, the system operator may not be able to determine whether the instrument is disposed in a part of the wellbore in which the wellbore diameter is substantially enlarged past the drilling bit diameter, or even enlarged past the operating diameter range of the fluid sample taking instrument. The system operator also may not be able to determine if the instrument is not well centered in the wellbore where the packer is placed into skewed contact with the wellbore wall. It is known in the art to use "caliper" logs to estimate whether the instrument is disposed in such an enlarged part of the wellbore. Caliper logging instruments which can be included with other types of wellbore logging instruments are well known in the art. See for example, U.S. Pat. No. 4,432,143 issued to Moriarty et al or U.S. Pat. No. 4,559,709 issued to Beseme et al. Generally speaking, the caliper logging instruments known in the art include an "arm" or other member which is placed in continuous contact with the wellbore wall. The arm is coupled to some type of position sensor to determine the amount of lateral extension of the arm from the instrument housing.

Using caliper logs which have been measured by instruments other than the formation sample taking instrument is not always conclusive as to whether the wellbore diameter at the selected formation sample depth is greater than the extension range of the formation fluid sample taking instrument. As is known in the art, the wellbore may "wash" or otherwise become enlarged past the diameters recorded by the earlier-run caliper log by the time the fluid sample taking instrument is to be run in the wellbore. It is therefore desirable to include a caliper instrument along with the formation sample taking instrument.

The typical wellbore caliper logging instrument is designed, however, for measurement while the instrument is being moved along the wellbore. Further, the typical wellbore caliper logging instrument includes complex linkages to couple the arm to the position sensor, because the sensor itself must generally be located inside the instrument housing to avoid destruction by the fluid in the wellbore. See U.S. Pat. No. 4,559,709 issued to Beseme et al for example. It has proven impracticable to include an arm-type caliper, or any other type of caliper, at the location of the probe in a formation fluid sample taking instrument, principally because the sample taking instrument includes a "back up" shoe or similar device which is hydraulically extended from the instrument housing at a circumferential location opposite to the probe, to force the probe into contact with the wellbore wall under very high lateral force. The complex hydraulic components necessary to actuate the typical back up shoe have made including a position sensor at the location of the back up shoe and probe very difficult.

SUMMARY OF THE INVENTION

The invention is an apparatus and method for measuring the internal diameter of a wellbore used with a wireline formation sample taking instrument. The apparatus includes an hydraulically actuated probe and back up shoe for selective engagement with the wall of a wellbore, an hydraulic pump and selectively controllable valves for selectively controlling the extension and retraction of the probe and back up shoe, and an hydraulic fluid reservoir to supply hydraulic fluid to the pump for extending and retracting the probe and back up shoe. The reservoir includes a pressure compensator for balancing the pressure in the reservoir to an hydrostatic pressure in the wellbore. A position sensor is coupled to the compensator for determining a position of the compensator in the reservoir, so that a measurement corresponding to a fluid volume in the reservoir can be made. The measurement corresponding to the fluid volume also corresponds to an amount by which the back up shoe and probe are extended outward from the instrument. The amount of extension corresponds to the internal diameter of the wellbore at the location of the probe and back up shoe.

In the method of the invention, the volume of fluid in the reservoir is measured, at the selected depth at which the instrument is to be "set" for taking a fluid sample, when the shoe and probe on the instrument are fully retracted. The shoe and probe are then extended, and the volume of fluid in the reservoir is measured again. The fluid volume corresponds to the amount of extension of the probe and shoe.

DESCRIPTION OF THE PREFERRED EMBODIMENT

A wireline formation sample taking instrument which is suitable for use with this invention is described in U.S. Pat. No. 5,635,631 issued to Yesudas et al, for example. It should be noted that the instrument described in the Yesudas et al '631 patent is not the only wireline formation sample taking instrument to which the invention can be adapted. Other wireline formation fluid sample taking instruments, such as the one described in the Moriarty et al '143 patent referred to earlier, can also be used with this invention. The elements of the formation sample taking instrument which are necessary for the invention will be further explained.

Figure 1:
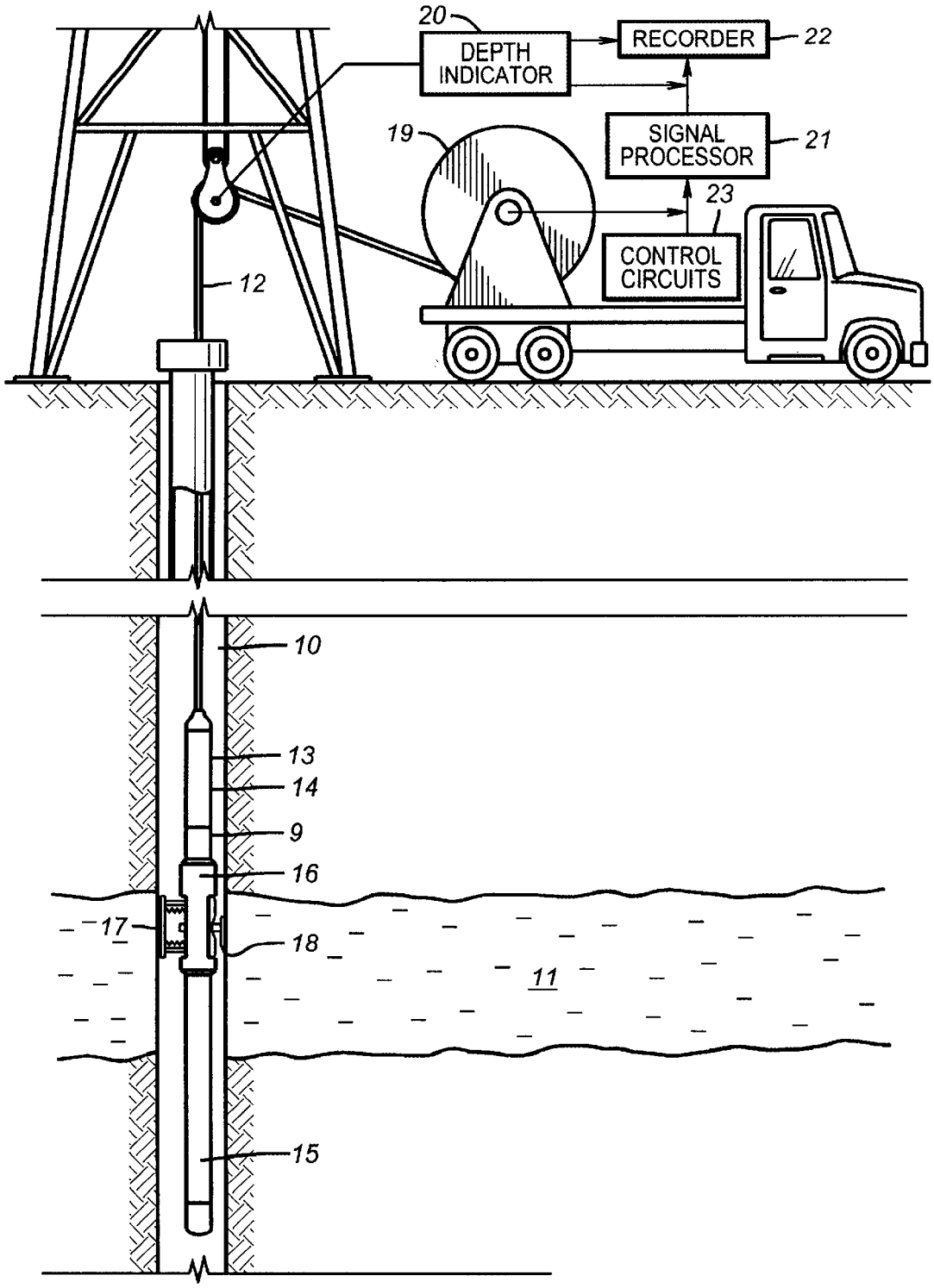
FIG. 1 shows a wireline formation fluid sample taking instrument disposed in a wellbore drilled through earth formations.

The sample taking instrument is shown in FIG. 1 generally at 13. The instrument 13 is attached to one end of an armored electrical cable 12 and can be lowered, using the cable 12, into a wellbore 10 drilled through the earth. The cable 12 can be extended into and withdrawn from the wellbore 10 by means of a winch 19 or similar device known in the art which is located at the earth's surface.

The instrument 13 includes a back-up shoe and an hydraulically actuated mechanism (not shown separately in FIG. 1) for extending the shoe, shown generally at 17, which are disposed within a housing 16. The mechanism will be further explained. The housing 16 also includes a tubular probe 18 which can be selectively extended and put into contact with the wall of the wellbore 10. A sample tank 15 can be attached to the lower end of the housing 16 and can be selectively hydraulically connected to the probe 18 in order to store samples of fluids withdrawn from the earth. The probe 18, the back-up shoe 17 and selective valves (not shown) disposed within the housing 16 for operating the probe 18 and the shoe 17 can be of types familiar to those skilled in the art, and can receive hydraulic operating power from an hydraulic power unit 9 attached to the upper end of the housing 16.

The various operating functions of the tool 13, including extension of the back up shoe 17 and extension of the probe 18, can be controlled by the system operator entering command signals into control circuits 23 which are located at the earth's surface and are electrically connected to the cable 12, as is understood by those skilled in the art. The command signals can be decoded in an electronics unit 14 disposed within the housing 16. The tool 13 can include sensors (not shown) for measuring pressure and volume within hydraulic lines (not shown in FIG. 1) connected to a sample chamber (not shown in FIG. 1). Measurements made by the sensors (not shown) can be transmitted to the earth's surface as electrical signals generated by the electronics unit 14. At the earth's surface the signals can be decoded by a signal processor 21 which is also electrically connected to the cable 12. The decoded signals are reformatted into measurements which can be both observed by the system operator and can be recorded by a recorder 22 connected to the signal processor 21.

As the tool 13 is lowered into the wellbore 10, the depth at which the tool is located is indicated by a depth indicator 20 which is in contact with the cable 12 and measures the amount of cable 12 extended into the wellbore 10. When the tool 13 is determined to be positioned adjacent to a formation of interest, shown generally at 11, the system operator enters commands into the control circuits 23 to lock the tool 13 in position by extending the back-up shoe 17. The probe 18 is then extended, and withdrawal of a fluid sample can be initiated.

Figure 2:
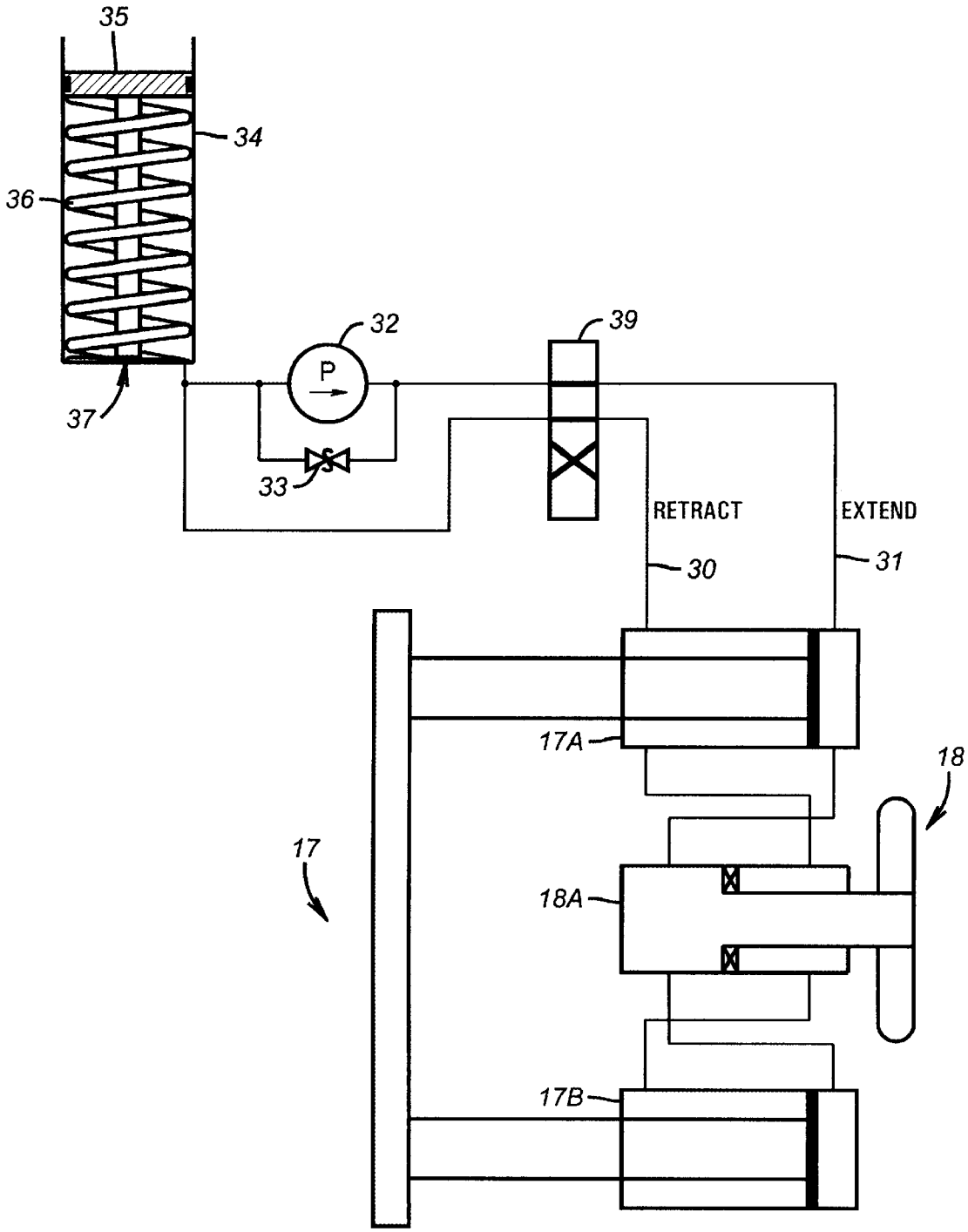
FIG. 2 shows hydraulic circuits for extending and retracting the back up shoe and probe for the instrument in FIG. 1, including a sensor for measuring the volume of hydraulic fluid in a reservoir in the instrument.

FIG. 2 shows in very simplified form the mechanism for extending and retracting the probe 18 and the back up shoe 17, as well as a sensor 37 which forms part of the invention. The hydraulic power unit (9 in FIG. 1) can include an electric motor-operated hydraulic pump 32 which draws hydraulic oil from a reservoir 34 disposed in the instrument housing. The pump 32 discharge pressure can be controlled by a regulator or bypass valve or the like, shown generally at 33. Hydraulic oil under pressure from the pump 32 can be selectively directed to an extension line 31, or a retraction line 31 by a crossover valve 39, which can be solenoid operated. When the pressurized oil is directed into the extend line 31, the oil is conducted to the extend side of hydraulic cylinder 18A which extends the probe 18, and cylinders 17A and 17B which extend the shoe 17. Low pressure oil from the other (retract) side of these hydraulic cylinders 17A, 17B, 18A can be returned to the reservoir 34 through the retract line 30 and crossover valve 39 as the cylinders extend. To retract the probe 18 and shoe 17, the crossover valve 39 is operated to direct the pressurized and returned oil to the opposite lines 31, 30.

In wellbore logging and sample taking instruments which include hydraulic actuation mechanisms for the probe and back up shoe such as those just described, the reservoir 34 is typically compensated for external hydrostatic fluid pressure in the wellbore (10 in FIG. 1). As is well known in the art, pressure compensation enables reliable extension and retraction of hydraulic cylinders such as those at 17A, 17B and 18A in FIG. 2 because the hydraulic oil prior to pressurization by the pump 32 is at substantially the same pressure as the hydrostatic fluid pressure in the wellbore 10. Therefore the hydraulic pressure applied by the pump 32 need not overcome the hydrostatic pressure to extend the cylinders. The compensation system shown in FIG. 2 is typical and includes a compensator piston 35 which is exposed to wellbore fluid pressure on one side and the reservoir oil on the other side. The compensation system typically includes a spring 36 or similar biasing means to keep the compensator piston 35 in the correct position irrespective of reservoir or external hydrostatic pressure.

In the invention, a position sensor, shown generally at 37, can be coupled to the compensator piston 35. The position sensor 37 can be a linear potentiometer or a linear variable differential transformer, both sensor types being known in the art. Typically, the sensor 37 can be exposed to the hydraulic oil without damage, while exposure to fluid under pressure in the wellbore would be destructive to the sensor 37.

Figure 3:
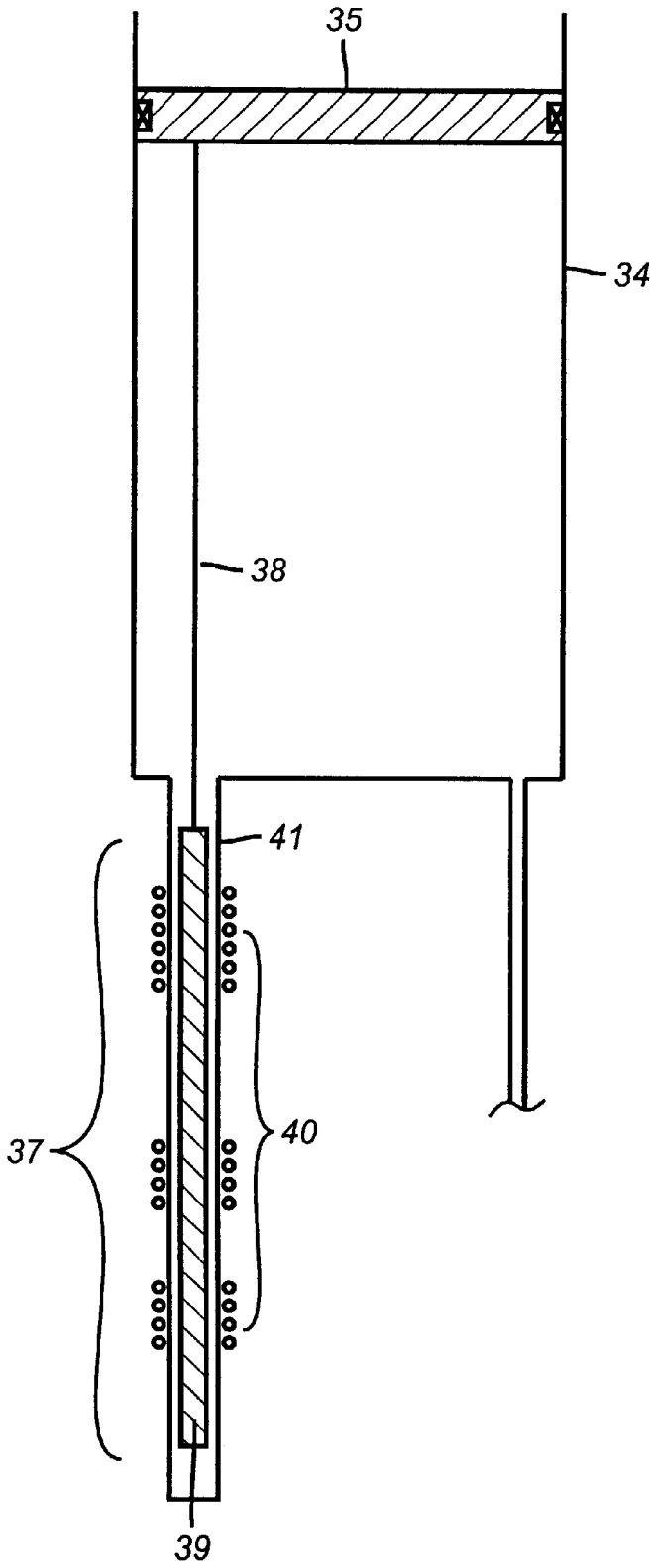
FIG. 3 shows an alternative embodiment of the sensor in FIG. 2.

Alternatively, as shown in FIG. 3, the sensor 37 can be disposed in a blind, pressure sealed tube 41. The sensor in this case is a linear variable differential transformed ("LVDT"). A magnetic core 39 is disposed inside the tube 41 and is coupled to the compensator piston 35 by a rod 38 or similar linkage. The output of the LVDT changes corresponding to the amount of the core 39 disposed within the cross sectional area enclosed by coils 40. A caliper using a type of LVDT motion sensor is described, for example in U.S. Pat. No. 5,299,359 issued to Estes at al.

Referring back to FIG. 2, the position of the compensator piston 35 in the reservoir 34 will be directly related to the volume of hydraulic oil in the reservoir 34. The hydraulic oil volume in the reservoir 34 will depend on, among other things, the ambient pressure and temperature in the reservoir 34, but primarily will depend on the amount by which the cylinders 17A, 17B, 18A are extended from the instrument housing (16 in FIG. 1). Hydraulic cylinders such as 17A, 17B, 18A have larger internal volume when they extended than when they are retracted primarily because of the volume of the piston and rod which are displaced from the cylinder itself when the cylinder is extended. It has been determined that the amount by which the cylinders 17A, 17B, 18A are extended is directly related to the oil volume in the reservoir 34 at any particular ambient pressure and temperature. Measurement of the position of the compensator piston 35 will therefore directly correspond to the volume of oil in the reservoir 34. Therefore the measurement of the position of the compensator piston 35 will correspond to the amount by which the cylinders 17A, 17B, 18A are extended.

The correspondence between the position of the compensator piston 35 and the amount of cylinder extension is also related, as previously explained, to the ambient pressure and temperature in the reservoir 34. It has been determined, however, that the relationship between the position of the compensator piston 35 and the amount by which the cylinders 17A, 17B, 18A are extended only requires recalibration for one known value of extension and compensator piston 35 position in order to enable determining the correct amount of extension of the cylinders 17A, 17B, 18A. One known value of extension is when the cylinders 17A, 17B, 18A are fully retracted (zero extension).

To calibrate the cylinder extension with respect to the position of the compensator piston 35, the position of the piston 35 can be measured first when the cylinders 17A, 17B, 18A are fully retracted. The calibration is preferably performed at the earth's surface with the instrument (13 in FIG. 1) in a test rack or the like. The cylinders 17A, 17B, 18A can then be extended inside a caliper "ring" (not shown), generally a hoop-shaped piece of steel having a known internal diameter. Caliper rings are well known in the art. After extending the cylinders 17A, 17B, 18A fully inside the ring (not shown), the position of the compensator piston 35 is again measured. Since the internal diameter of the ring is known, the new position of the compensator piston 35 will then be calibrated with respect to a known amount of extension of the cylinders 17A, 17B, 18A. This process can be repeated for a number of other diameter caliper rings, until substantially all of the extension range of the cylinders 17A, 17B, 18A has been covered by this calibration process. As a practical matter, it has been determined that it is only necessary to calibrate the cylinder extension/compensator piston position at one known diameter larger than the fully retracted position to obtain quantitative measurements of the amount of extension of the cylinders 17A, 17B, 18A, since the relationship is substantially linear. This calibration results in a characterization of the position of the compensator piston 35 with respect to the amount by which the cylinders 17A, 17B, 18A are extended. The amount by which the cylinders 17A, 17B, 18A are extended generally corresponds to the internal diameter of the wellbore at the particular test depth for which a fluid sample is to be taken.

When the instrument (13 in FIG. 1) is used in an actual wellbore, the effects of ambient pressure and temperature at any particular sample test depth on the position of the compensator piston 35 can be accounted for by measuring the position of the compensator piston 35 at "zero" extension of the cylinders 17A, 17B, 18A to determine an offset (a value added to each measurement) by which to adjust the values of the relationship determined in the calibration done at the earth's surface. The offset preferably is determined at each test depth to maintain accuracy of the measurements.

When a sample it to be taken at any particular depth in the wellbore (10 in FIG. 1), the amount of extension of the cylinders 17A, 17B, 18A can be measured while the instrument is "set". If it is determined that the internal diameter of the wellbore 10 likely exceeds the extension range of the cylinders (usually by the measurement showing a wellbore diameter equal to the maximum possible amount of extension of the cylinders), the system operator can retract the cylinders 17A, 17B, 18A and move the instrument 13 to a different depth where the wellbore diameter may be within the extension range of the cylinders 17A, 17B, 18A. This represents a substantial improvement over the operation of prior art formation sample taking instruments, where the only indication that the cylinders were fully extended was obtainable by the system operator observing the pressure in the hydraulic lines. The hydraulic pressure would show a similar indication whether the shoe 17 and probe 18 were in contact with the wellbore wall or the cylinders were fully extended where the wellbore was too big to enable the shoe 17 and probe 18 to "seat" on the wellbore wall. The invention enables the system operator to determine whether failure to properly seal the probe 18 against the wellbore wall is a result of enlarged wellbore diameter.

In cases where the instrument 13 is not well centered in the wellbore so that the probe 18 would be placed into skewed contact with the wellbore wall, the measurement of wellbore diameter obtained by the invention may actually be less than the diameter of the drill bit used to drill the wellbore, because the orientation of the instrument in the wellbore may prevent the probe 18 and shoe 17 from extending to the full diameter of the wellbore. Measurements made by the invention which indicate that the probe 18 and shoe 17 are extended to less than the diameter of the drill bit can therefore be used to indicate probable skewed contact of the probe 18 with the wellbore wall. In this case the system operator may elect to move the instrument 13 slightly in the wellbore to relieve the skewed contact condition.

While the particular embodiment of the invention described herein forms part of a wireline formation sample taking instrument, those skilled in the art of well logging will recognize that the invention can also be used with any instrument having hydraulically extensible and retractable arms, shoes, pads or the like to be selectively placed in contact the wall of a wellbore or casing and to measure the internal diameter of the wellbore or casing. U.S. Pat. No. 5,680,049 issued to Gissler et al, for example, describes an instrument for measuring resistivity of a wellbore having a conductive metal casing inserted therein. The invention can be readily adapted to measure the amount of extension of extensible "arms" on the instrument described in the Gissler et al patent, since they are hydraulically actuated, and the instrument includes an hydraulic fluid reservoir to supply fluid for extending and retracting the arms. In particular, hydraulically actuated arms, shoes or the like can have the power necessary to lift a well logging instrument away from the lower wall of a wellbore which is drilled at very high inclinations from vertical. In conjunction with the invention, such devices may have the capacity to measure the diameter of such highly inclined wellbores whereas caliper instruments known in the art may lack such ability.

Those skilled in the art will devise other embodiments of this invention which do not depart from the spirit of the invention as described herein. Accordingly, the invention should be limited in scope only by the attached claims.

What is claimed is:

1. A wireline instrument for taking samples of formation fluid and for measuring an internal diameter of a wellbore, said instrument comprising:

a hydraulically extended mechanism for extraction of formation fluid, said mechanism being disposed for lateral extension from an instrument housing;

a hydraulic pump and selectively controllable valves for selectively controlling the lateral extension of said mechanism from said instrument housing into compressive engagement of a wellbore wall; and, a hydraulic fluid reservoir to supply hydraulic fluid to said pump for extending and retracting said mechanism, said reservoir including a sensor for measuring a volume of said hydraulic fluid in said reservoir, said measured volume substantially corresponding to a diameter of said wellbore that is engaged by said mechanism.

2. The instrument as defined in claim 1 wherein said reservoir comprises a pressure compensator for balancing pressure in said reservoir to a hydrostatic pressure in said wellbore and wherein said sensor is coupled to said pressure compensator so that measuring a position of said compensator provides a measurement corresponding to said volume.

3. The instrument as defined in claim 2 wherein said sensor comprises a linear variable differential transformer.

4. The instrument as defined in claim 2 wherein said sensor comprises a linear potentiometer.

5. The instrument as defined by claim 1 wherein said mechanism comprises a probe and a back up shoe, each oppositely extending from said housing.

6. A method for measuring an internal diameter of a wellbore, comprising:

providing an axially elongated well logging instrument;

providing a radially expandable mechanism for compressively engaging the side wall of a wellbore;

expanding said mechanism by the pumped displacement of hydraulic fluid from a reservoir;

calibrating a correlation between a measured volume of hydraulic fluid in said reservoir and the substantial diameter of a perimeter substantially encompassing said expandable mechanism;

inserting said well logging instrument into said wellbore;

expanding said mechanism into compressive engagement with said side walls of said wellbore;

measuring the volume of fluid in said reservoir when said mechanism compressively engages said sidewalls; and, determining the substantial diameter of said wellbore from the measured volume in said reservoir.

7. The method as defined in claim 6 wherein said steps of measuring said fluid volume are performed by measuring a position of a pressure compensator in said reservoir, said compensator for communicating a hydrostatic fluid pressure in said wellbore to said fluid in said reservoir.

8. The method as defined in claim 7 wherein said position is measured by a linear variable differential transformer coupled to said compensator.

9. The method as defined in claim 7 wherein said position is measured by a linear potentiometer coupled to said compensator.

10. The method as defined in claim 6 wherein said well logging instrument comprises a formation fluid sample taking instrument comprising a probe for selective engagement with said wellbore sidewall for withdrawing fluids from pore spaces in a formation penetrated by said wellbore.

11. An apparatus for measuring an internal diameter of a wellbore, comprising:

a hydraulically actuated mechanism disposed for selective extension from an instrument housing into compressive engagement with a sidewall of said wellbore;

a hydraulic pump and selectively controllable valves for selectively controlling the extension and retraction of said mechanism relative to said instrument housing;

a hydraulic fluid reservoir to supply hydraulic fluid to said pump for extending and retracting said mechanism, said reservoir including a sensor for measuring the volume of hydraulic fluid in said reservoir, said sensor having a calibrated correlation between the measured volume of hydraulic fluid in said reservoir and the substantial diameter of the wellbore that is compressively engaged by said mechanism.

12. The apparatus as defined in claim 11 wherein said sensor comprises a pressure compensator disposed in said reservoir for balancing pressure in said reservoir to a hydrostatic pressure in said wellbore, and a sensor coupled to said pressure compensator whereby measurement of a position of said compensator provides a measurement corresponding to said volume in said reservoir.

13. The apparatus as defined in claim 12 wherein said sensor comprises a linear variable differential transformer.

14. The apparatus as defined in claim 12 wherein said sensor comprises a linear potentiometer.

15. The apparatus as defined in claim 11 wherein said amount by which said mechanism is extended from said housing is determined from a measurement differential between the fluid volume in said reservoir when said mechanism is retracted and when said mechanism is extended.

* * * * *